US011344084B1

(12) United States Patent
Stapleton et al.

(10) Patent No.: US 11,344,084 B1
(45) Date of Patent: May 31, 2022

(54) BOOT-BINDING SYSTEM

(71) Applicant: Innovative Aerospace, Southwick, MA (US)

(72) Inventors: Thomas J Stapleton, Southwick, MA (US); Lynne Ann Stapleton, Southwick, MA (US)

( * ) Notice: Subject to any disclaimer, the term of this patent is extended or adjusted under 35 U.S.C. 154(b) by 133 days.

(21) Appl. No.: 16/846,760

(22) Filed: Apr. 13, 2020

Related U.S. Application Data

(60) Provisional application No. 62/845,353, filed on May 9, 2019.

(51) Int. Cl.
*A43C 11/00* (2006.01)
*A63C 9/084* (2012.01)
*A63C 13/00* (2006.01)

(52) U.S. Cl.
CPC ..... *A43C 11/00* (2013.01); *A63C 9/084* (2013.01); *A63C 13/001* (2013.01)

(58) Field of Classification Search
CPC ..... B64G 6/00; A43B 5/0403; A43B 5/0409; A43B 5/0417; A63C 9/20; A63C 9/086; A63C 9/0846; A63C 10/10; A63C 10/106; A63C 10/285; A63C 13/001
See application file for complete search history.

(56) References Cited

U.S. PATENT DOCUMENTS 3,751,727 A * 8/1973 Shepard ..... B64G 6/00 600/20
3,961,802 A * 6/1976 Vannatter ..... A63C 9/0846 280/631
4,273,354 A * 6/1981 George ..... A43B 5/04 280/614
4,728,115 A * 3/1988 Pozzobon ..... A63C 9/086 280/611
4,746,139 A * 5/1988 Dimier ..... A63C 9/08 280/631
5,020,822 A * 6/1991 Wulf ..... A43B 5/0417 36/117.3
5,070,964 A * 12/1991 Monford, Jr. ..... B66F 11/044 182/141
5,704,139 A * 1/1998 Okajima ..... A43B 5/0401 36/117.3
5,722,680 A * 3/1998 Dodge ..... A43B 5/0423 280/14.22
6,213,493 B1 * 4/2001 Korman ..... A63C 10/24 36/117.3
6,328,328 B1 * 12/2001 Finiel ..... A63C 10/285 280/14.22
6,375,212 B1 * 4/2002 Hillairet ..... A63C 9/086 280/624
6,394,484 B1 * 5/2002 Maravetz ..... A43B 5/0421 280/14.22

(Continued)

*Primary Examiner* — Jeffrey J Restifo

(57) ABSTRACT

A boot-binding system includes a sole plate, integrated into an inner boot, that mates to a second sole plate that may be integrated into the floor of a pressurized vehicle or integrated into an outer boot configuration also referred to as a surface boot, a spring loaded pin/bushing arrangement couples the sole plates, while a latching mechanism located on the surface boot sole plate captures the heel of the inner boot sole plate against a spring loaded heel plate integrated into the surface boot sole plate that presses upwards against the inner boot heel.

14 Claims, 13 Drawing Sheets

(56) References Cited

U.S. PATENT DOCUMENTS 6,409,204 B1 * 6/2002 Ayliffe ..... A63C 9/20 36/117.3
6,460,871 B1 * 10/2002 Dodge ..... A63C 10/103 280/14.22
6,499,757 B1 * 12/2002 Berger ..... A63C 10/10 280/607
6,499,760 B1 * 12/2002 Tindall ..... A63C 10/106 280/607
6,554,295 B2 * 4/2003 Rittmeyer ..... A63C 10/06 280/14.22
6,663,138 B1 * 12/2003 Zanatta ..... A43B 5/0403 280/634
2001/0001519 A1 * 5/2001 Couderc ..... A63C 10/285 280/607
2001/0010422 A1 * 8/2001 Merino ..... A63C 10/10 280/607
2001/0015542 A1 * 8/2001 Joubert Des Ouches ..... A63C 10/285 280/607
2002/0030349 A1 * 3/2002 Yvars ..... A43B 5/0423 280/617
2002/0041081 A1 * 4/2002 Gonthier ..... A63C 10/285 280/623
2002/0093175 A1 * 7/2002 Martin ..... A63C 10/10 280/613
2003/0046829 A1 * 3/2003 Baechtold ..... A43B 5/0421 36/15
2003/0094790 A1 * 5/2003 Poscich ..... A63C 10/10 280/618
2003/0197350 A1 * 10/2003 Laughlin ..... A63C 10/24 280/624
2004/0232658 A1 * 11/2004 Poscich ..... A63C 10/10 280/618
2007/0108734 A1 * 5/2007 Korich ..... A63C 10/285 280/607
2008/0116663 A1 * 5/2008 Gyr ..... A63C 9/20 280/611
2010/0242308 A1 * 9/2010 Belles ..... A43B 5/0417 36/132
2013/0000154 A1 * 1/2013 Trinkaus ..... A43B 5/0484 36/103

* cited by examiner

100

200

200

200

200

BOOT-BINDING SYSTEM

TECHNICAL FIELD

The disclosed embodiment is directed to parts of footwear including uppers, boot legs; stiffeners and other single parts of footwear, as well as heels and top pieces and sole and heel units. It is more particularly directed to an inner boot-binding system for people working in pressurized habitats such as a space station, submarine or Nuclear-Biological-Chemical (NBC) vehicle; workers who wear pressurized suits for lunar or planetary exploration or deep-sea diving; or those working in hazmat environments. Suits used in these environments contain a "life support backpack" which circulates fresh air within the pressurized suit.

BACKGROUND

Astronauts exposed to a microgravity environment, such as that in the pressurized International Space Station, secure themselves in place by sliding their feet under toe bars located throughout the habitat. Activity performed inside a pressurized environment or vehicle, for example, working on equipment or tending experiments, is called Internal Vehicle Activity (IVA). Activity performed outside a pressurized environment or vehicle is called External Vehicle Activity (EVA).

A "pressurized suit" is a protective garment that isolates a wearer from the outside environment such as the vacuum of space; highly pressurized salt water; or environments of hazardous gasses.

A pressurized suit boot-binding system secures a wearer to an inner boot during IVA, and to an outer or "surface" boot during EVA. During EVA, crew-members wear pressurized suits and pressurized outer boots. The boots have in the past used a Velcro strap on the exterior of the outer boot to secure them during lunar EVA. This type of clip was used during the Apollo lunar missions.

Some elements of pressurized suits impede movement and make activity difficult. During IVA, use of stabilizing toe bars have reportedly caused foot fatigue and injury. During EVA, walking, kneeling and completing tasks, as well as managing the considerable mass of the pressurized suit, is reportedly arduous and difficult and can cause foot fatigue and injury. Stability is further challenged because a life-support backpack shifts the wearer's center of gravity backward, resulting in counter-balancing movements. The stiffness and bulk of the suit make it difficult to counter the offset center of gravity. Further impediments to movement are caused by the suit's internal pressure, which is higher than ambient pressure.

Occupations requiring strenuous tasks while isolated from the environment include those of astronauts (referred to here as the crew or crew members), deep-sea divers, and workers wearing hazmat suits. Occupations requiring traverse across rugged, hot or cold surfaces requires a garment system that ties body garments to footwear and that can secure the foot to a thermal-isolating surface boot. A pressurized boot-binding system must allow easy doffing and donning of both pressurized suit and surface boot without snagging or tearing the pressure barrier in the pressurized suit.

Although special suits have been developed to isolate wearers from harsh environments, conventional pressurized suit boots are not adequately developed for traverse across rugged terrain in extreme temperature conditions. A safe temperature range for any continuous-contact surface ranges from 50° F. to 111° F. But surfaces on the earth's moon range from −185° F. to 210° F. Current systems involve thick, soft insulation material that resist heat transfer. The thick, soft material allows feet to slide about inside the boots, sometimes resulting in injury. A boot-binding system should firmly secure wearers' feet during IVA, and to a surface boot during EVA, while allowing the flexibility needed to work in thermally challenging conditions while wearing a pressurized suit.

SUMMARY

A surface boot-binding system is configured to provide stability, flexibility and thermal isolation to individuals in occupations requiring isolation from harsh environments.

Adapted for use with a pressurized suit, the system assists in thermally isolating the wearer's feet from surface temperatures, and enables easy and predictable donning and doffing. Because the surface boot-binding system employs manually operable spring elements, it can be customized to accommodate various foot sizes and flexibility preferences.

A binding system mounts an inner boot to an IVA-binding plate, as well as to a surface boot during EVA. During IVA, the embodiment's binding system enables securing the wearer to receiver bindings variously located on habitat surfaces, separate from a wearer.

The system enables comfortable traverse along rugged terrain to one wearing a pressurized suit and carrying a life-support backpack during EVA. Flexible sole plates and embedded springs assist in thermally isolating the wearer from outer surface temperatures while providing comfort adjustment.

An inner boot is affixed to an inner sole plate which includes a toe-pin receptacle and a heel catch. An outer boot has a ring structure at its opening for connecting it to the leg of a pressurized suit. The outer boot is affixed to an outer-sole plate that includes a toe-pin mechanism and a heel-latch mechanism for attaching the outer boot to a leg of a pressurized suit.

A release cord is pulled to release the outer-sole plate heel-latch. A toe-pin mechanism may be oriented below the wearer's metatarsophalangeal joints to allow toes to flex.

The toe-pin mechanism may be affixed to a base structure and outer-sole plate. A toe pin and receptacle are seated against a pin spring-plate with an adjustment screw.

In some embodiments a heel mechanism joins an inner-sole plate heel catch to a latch in an outer-sole plate. The latch is held in a normally closed position with a spring or compressible material. Pulling a release cord actuates a linkage to move a shaft that releases the heel catch, releasing the inner sole from the outer-sole plate.

An inner-sole plate has toe-pin receptacles at its forward or toe end and a catch support on its back or heel end. The inner-sole plate structure is affixed to an inner-sole plate to provide rigidity. Similarly, an outer-sole plate structure is affixed to the outer-sole plate to provide rigidity. This outer-sole plate structure has toe-pin mechanisms at its forward (toe) end, and a heel mechanism at its back (heel) end. The outer sole plate includes a heel-latch mechanism housing and cover formed of flexible elastomeric material designed to protect the heel latch from dust and debris.

The outer sole-plate is adapted to alternatively affix to a surface so that a wearer may clip in to it, i.e., secure the inner boot to an externally positioned outer-sole plate.

The outer boot has a structural ring for attaching it to the leg of a pressurized suit.

A heel mechanism is connected to an outer-sole plate that is engaged with an outer boot. Boot and suit are connected by use of a connection ring.

An inner-sole plate is affixed to an inner boot. The inner-sole plate has a catch that mates with a latch in the heel mechanism, and at least one pin-and-hole alignment to the outer-sole plate. A compressible elastic material surrounds alignment pin(s).

The latch is released by moving a linkage which releases the catch from the latch. A secondary cover prevents unintended actuation of the linkage.

In another example embodiment the clip-in mechanism is positioned under the metatarsal joint to allow the foot to flex, easing walking and kneeling. This clip-in mechanism may be adjusted by manipulating a knob that controls spring tension.

Elastomeric padding between mechanisms provides vertical spring tension to secure the inner boot catch to the binding system latch and reduces wear on some of the system's moving parts and fatigue to the user. The padding is designed to also insulate the foot against exterior temperatures.

In some embodiments, the outer-sole plate has base structure at the toe and heel areas that translate force by wearer to the surface boot.

Springs in the integrated inner- and outer-sole plate system enable plates to move independently to offset unwanted movement resulting from manufacturing tolerance in the lateral and forward-and-aft directions between the sole plates. In order for the pins to fit into the bushings, the pin must have an outer-diameter clearance between 0.001" to 0.050." This accounts for varying fit tolerances due to material and size changes occurring under ambient temperature changes: as pins expand or contract, pin/bushing compression springs and heel-plate compression springs move to accommodate changes in size, reducing clearance between parts.

Toe spring tension is manually adjustable and may be customized prior to EVA. A heavy person might tighten spring tension and a person of lighter weight might loosen it. Adjustments might also be made to offset varying gravitational constants.

One skilled in the art understands that pins may be machined to shapes other than cylindrical. A faceted shape minimizes twisting in its hole.

One skilled in the art understands that inner or outer sole plates may be made of non-conductive materials to protect a foot from environments of harsh temperatures, and specifically to prevent heat transfer between the pin of the outer boot and the receptacle of the inner boot. One skilled in the art understands that the inner and outer sole plates may be made of metallic or non-metallic materials to enhance foot flexibility.

In some embodiments involved motion and actuation forces are within accepted human anthropometric values.

DETAILED DESCRIPTION

Figure 1:
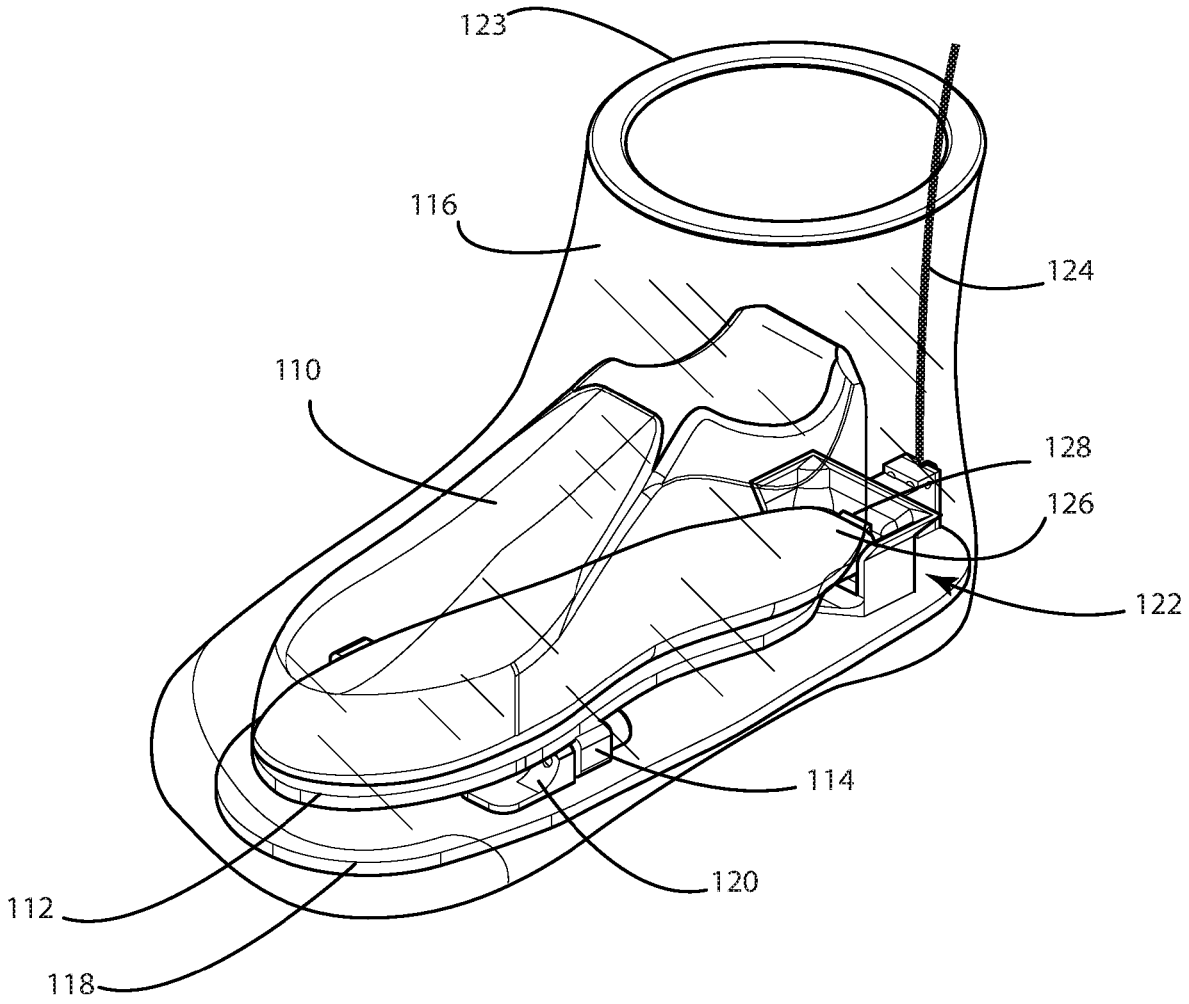
FIG. 1 is a perspective view of a first iteration of an example embodiment.

In FIG. 1 an inner boot 110 and outer boot 116 are illustrated as transparent for clarity.

Figure 2:
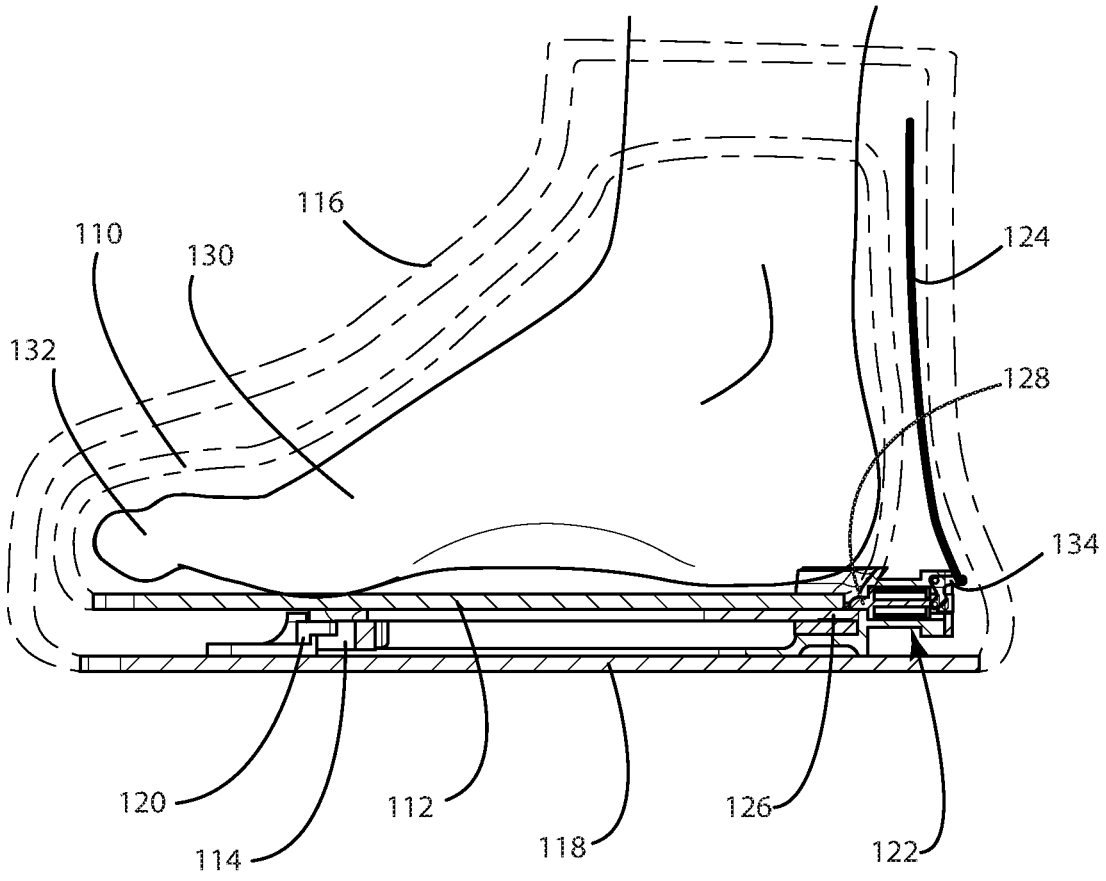
FIG. 2 is a partial section view.

In FIG. 2, both inner boot and outer boot are illustrated in dashed lines illustrating the relationship between the inner boot 110, the outer boot 116 and a wearer's foot 130 toes 132.

In FIGS. 1 and 2, an inner boot 110 is affixed to an inner sole plate 112 which includes a toe-pin receptacle 114 and a heel catch 126. The outer boot sole plate includes a heel-latch mechanism 122 (FIG. 1) for attaching the outer boot 116 to a leg of a pressurized suit. The outer boot has a ring structure 123 for connecting to the leg of a pressurized suit. The outer boot is affixed to an outer-sole plate 118 that includes a toe-pin mechanism 120 and a heel-latch mechanism 122. The heel-latch mechanism 122 employs a heel latch 128 that is spring-loaded to a normally closed position for fitting over an inner-sole plate catch 126. A release cord 124, when pulled, moves the linkage 134, which releases the outer-sole plate heel-latch 128. In some embodiments, the toe-pin receptacle 114 and toe-pin mechanism 120 combination is disposed just below the wearer's metatarsophalangeal joints such that the wearer's toes 132 are cantilevered over the toe-pin receptacle 114 and toe-pin mechanism 120 combination. This orientation of the toe-pin mechanism allows the toes to flex. One skilled in the art understands that the binding system illustrated as described, does not require permeation through the outer surface to actuate the linkage.

Figure 3:
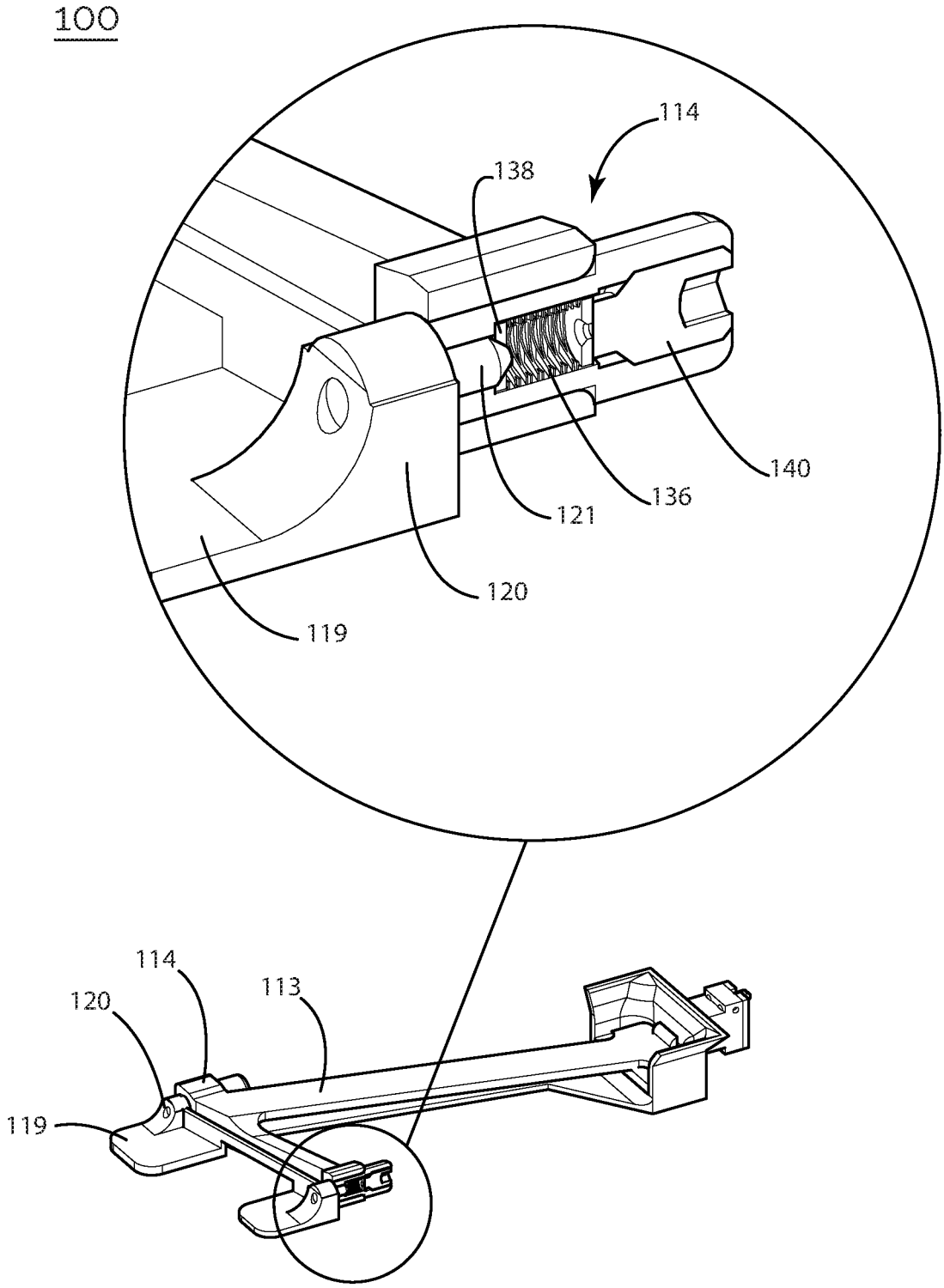
FIG. 3 is a perspective, partial section, detailed view.
Figure 4:
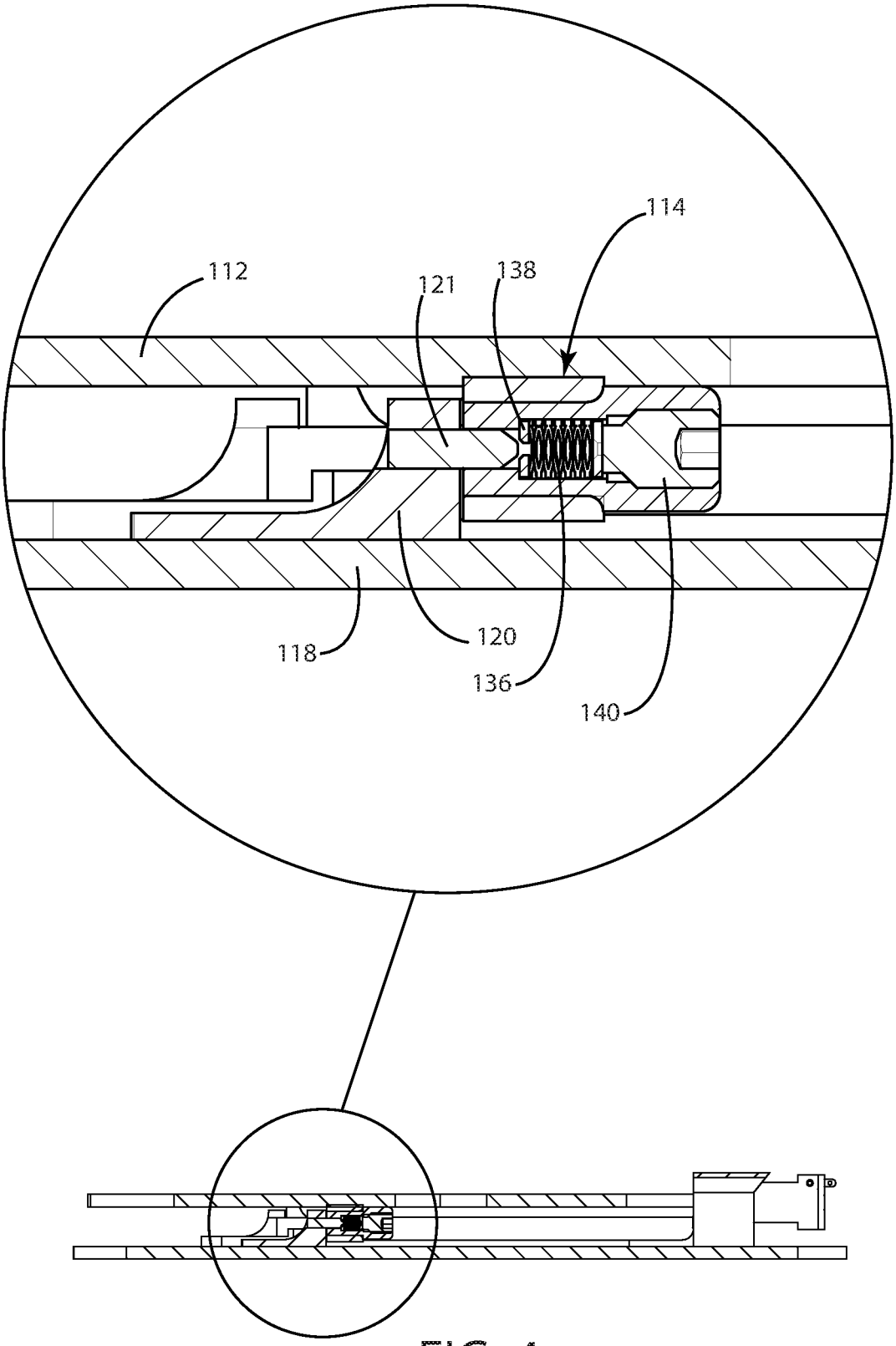
FIG. 4 is a cross-section, detailed view.

In FIGS. 3 and 4, a toe-pin mechanism 120 is affixed to an outer-sole plate 118 and supports a toe pin 121. In some embodiments the toe-pin mechanism 120 is affixed to a base structure 119 that further is affixed to an outer-sole plate 118. A toe-pin receptacle 114 is affixed to an inner-sole plate 112. A toe pin 121 fits into a toe-pin receptacle 114 and seats against a pin spring-plate 138. The pin spring-plate 138 has a hole with a conical cross-section seating against a mating toe pin 121. The pin spring-plate 138 is held against the toe pin 121 by a spring 136. The compression tension on the spring 136 may be adjusted by the adjustment screw 140.

Figure 5:
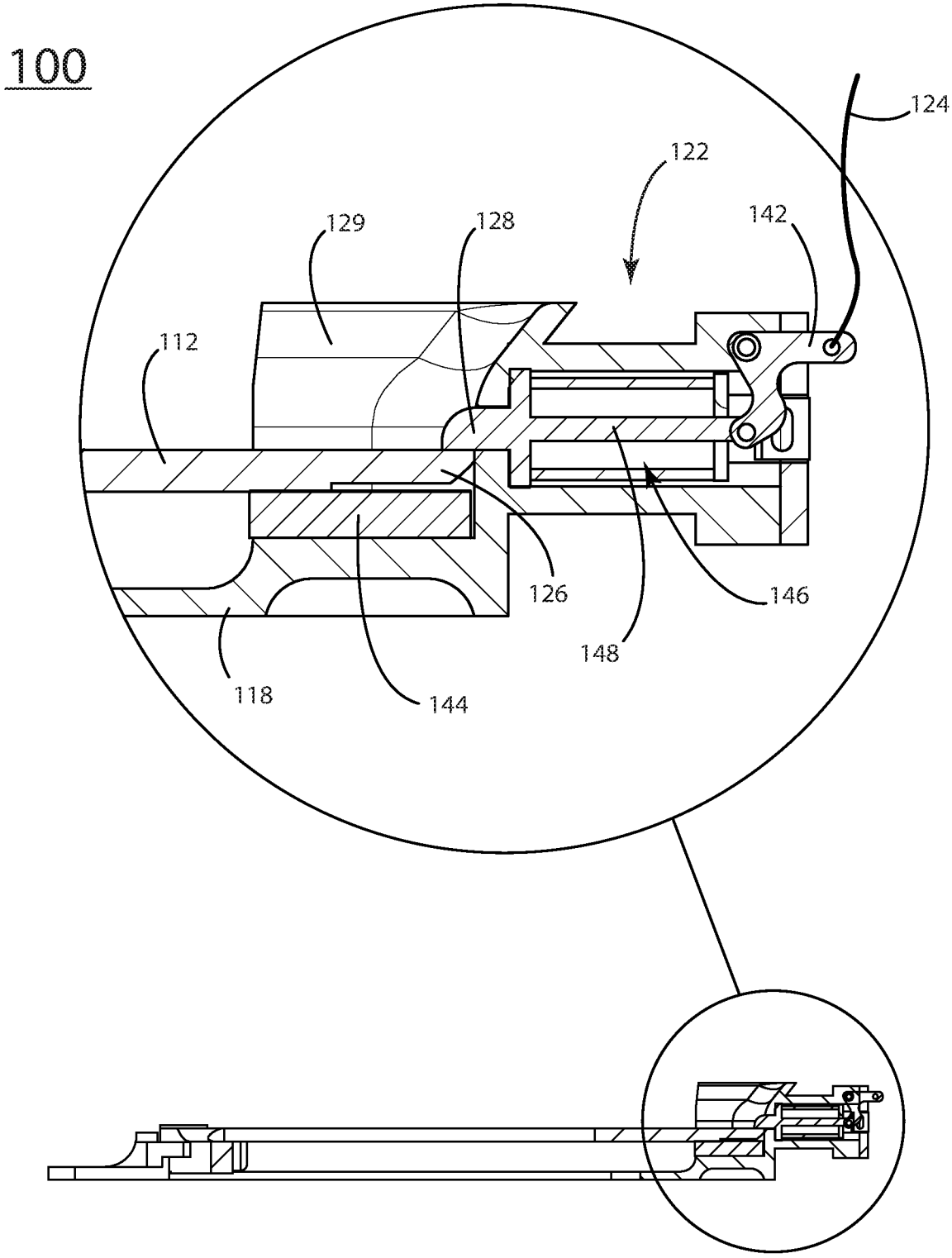
FIG. 5 is another cross-section, detailed view.
Figure 6:
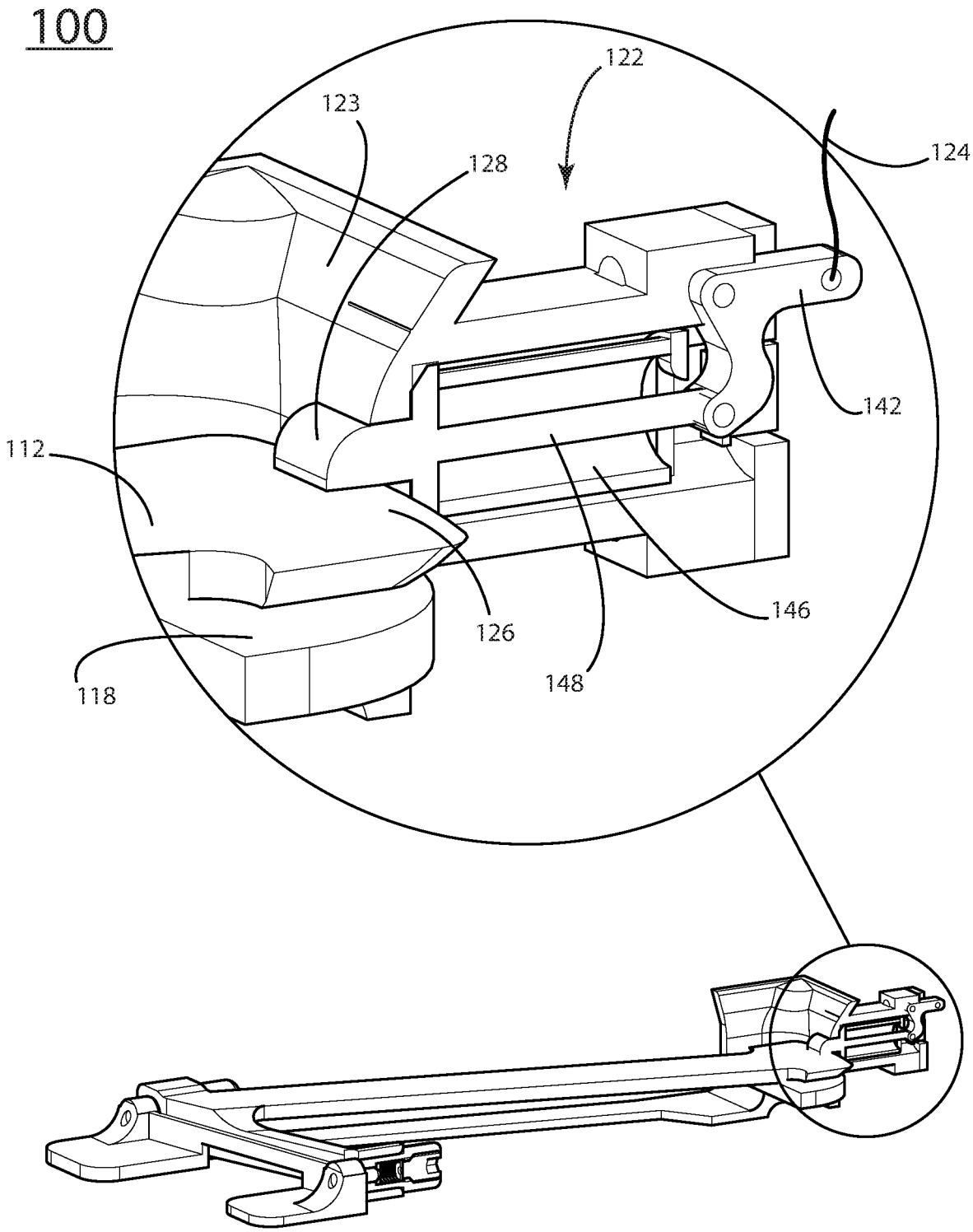
FIG. 6 is a perspective, partial section, detailed view.

FIGS. 5 and 6 show an example heel mechanism 122 that joins an inner-sole plate heel catch 126 with a latch 128 in an outer-sole plate. The heel mechanism 122 has a beveled heel receptacle 129 which houses a latch mechanism and guides the inner boot toward the latch mechanism. A latch 128 is supported by a shaft 148 that is connected to a linkage 142. The latch is held in a normally closed position with a spring, or other compressible elastic material 146. An example compressible elastic material 146 is shown in the example. One skilled in the art understands that a compression spring may also fit in the same space. The linkage 142 moves the shaft 148 so as to hold or release a heel catch 126 on an inner-sole plate 112. The linkage is actuated by a release cord 124 that extends upward from inside the outer boot to a location that may be reached by the wearer. The inner-sole plate 112 and catch 126 rest on compressible elastic material 144, holding the catch 126 fast against the latch 128. The elastic material 144 is attached to the outer-sole plate 118. One skilled in the art understands that a spring-loaded connection allows for dynamic movement of the system while maintaining surface-to-surface contact between components such as the catch 126 and latch 128.

Figure 7:
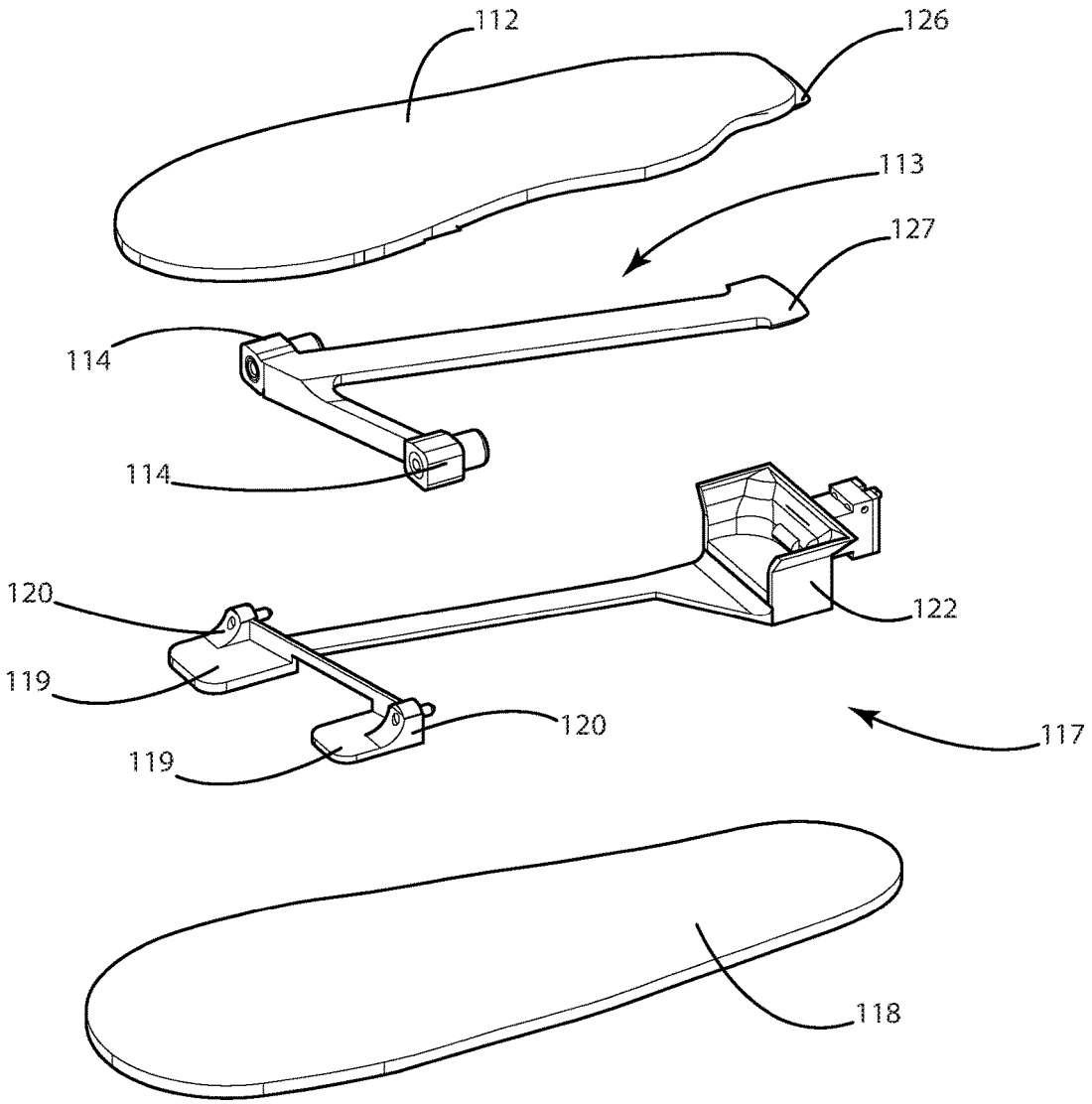
FIG. 7 is a perspective, exploded view.

FIG. 7 shows the relationship between the inner-sole plate 112, inner-sole plate support structure 113, outer-sole plate 118 and outer-sole plate structure 117. The inner-sole plate structure 113 joins a pair of toe-pin receptacles 114 and a catch support structure 127. The inner-sole plate structure 113 is affixed to a sole plate 112 and provides rigidity to the sole plate 112 and further supports the catch 126. The outer-sole plate 118 is affixed to the outer-sole plate structure 117 which provides rigidity to the sole plate 118 and joins a pair of toe-pin mechanisms 120 and a heel mechanism 122. Connection surfaces 119 are fastened to the outer-sole plate 118.

Figure 8:
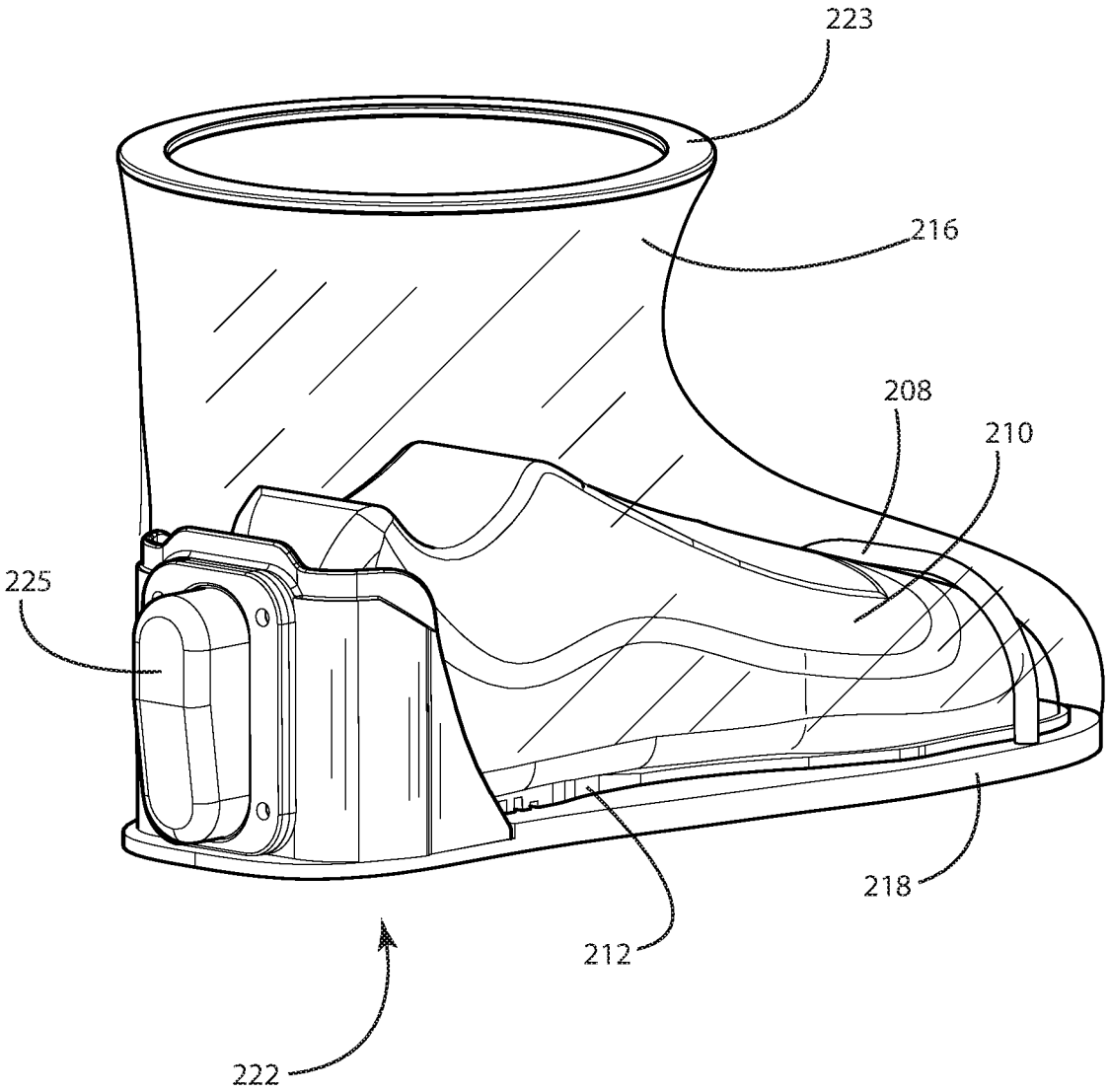
FIG. 8 is a perspective view of a second iteration of an example embodiment.
Figure 9:
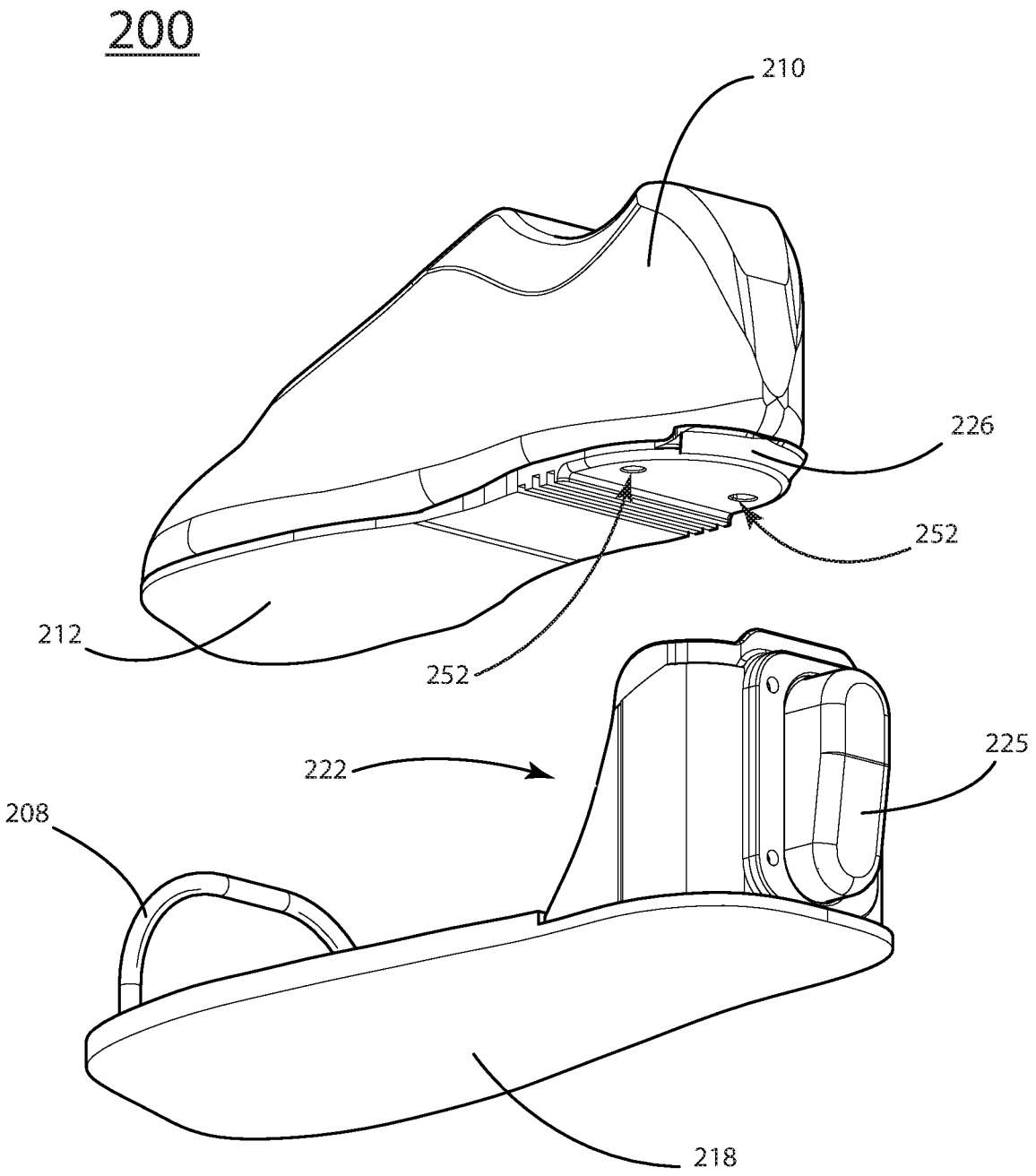
FIG. 9 is a rear exploded view.
Figure 10:
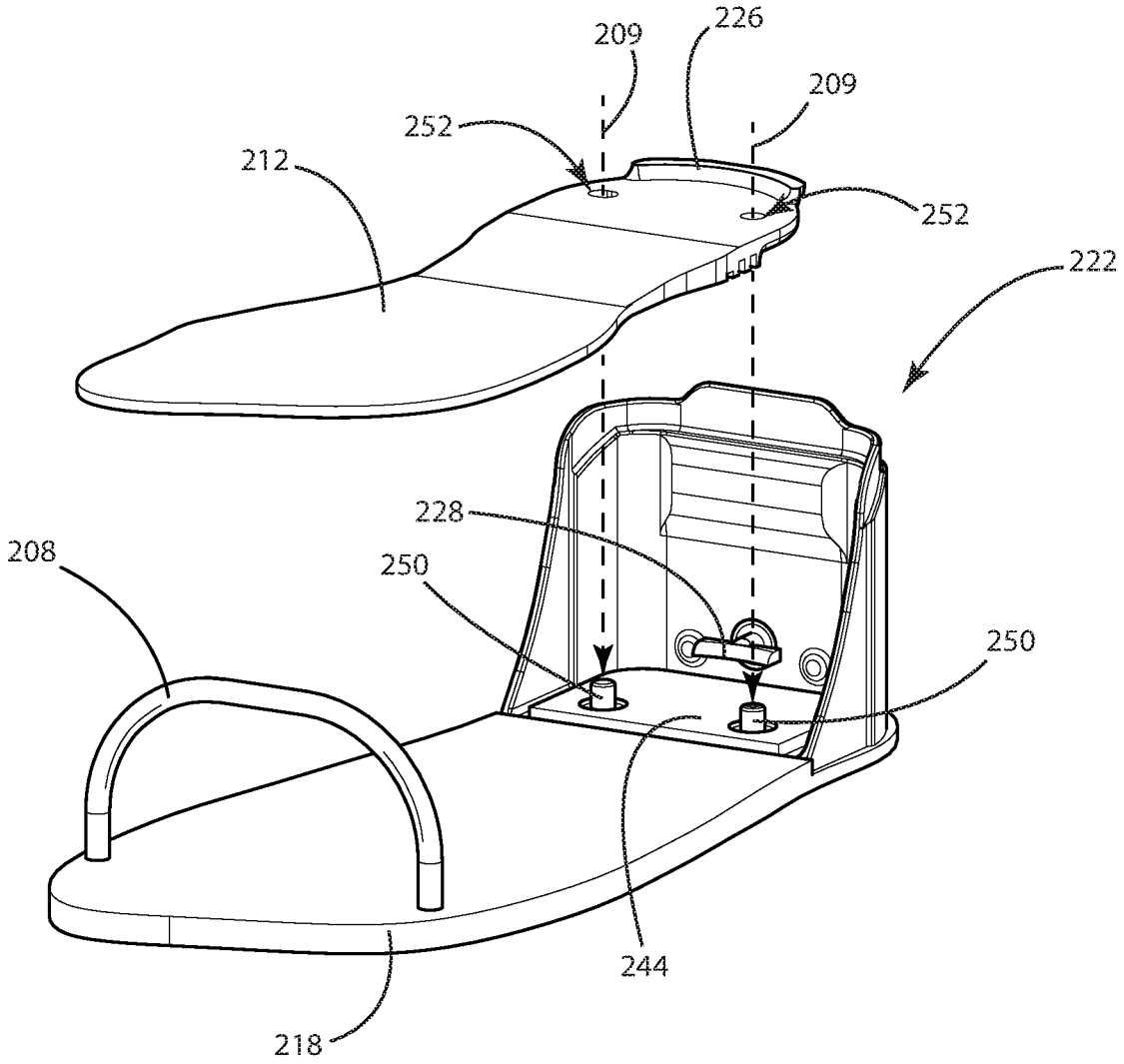
FIG. 10 is a front exploded view.

Referring to FIGS. 8, 9 and 10, FIG. 8 shows a transparently drawn outer boot 216, an inner boot 210, an inner-sole plate 212 and an outer-sole plate 218. FIG. 9 is a partially exploded view that shows an inner boot and an outer sole-plate. FIG. 10 is a partially exploded view that shows an inner sole-plate and an outer sole-plate. The outer sole plate 218 includes a heel-latch housing 222 which further includes a heel-latch mechanism cover 225. A flexible elastomeric heel-latch mechanism cover 225 keeps dust/debris out of the heel-latch mechanism, while allowing access to manipulate a linkage in the mechanism. The elastomeric cover 225 allows a user to release the inner sole plate from the outer sole plate without permeating the pressure barrier. A toe bar 208 is fastened to the outer sole plate 218 and holds the toe of the inner boot 210 attached to the outer sole plate 218. One skilled in the art understands that a user may insert a toe under a toe bar and then click the catch 226 into the latch 228 to fasten the inner sole plate, and thus the inner boot, to the outer sole plate. A set of seals 239 maintains a pressure barrier between the interior of the boot and thus the pressurized suit and the outer environment. The set of seals 239 provide multiple redundancies by sealing against the shaft while allowing movement of the shaft. An additional layer of environmental seal is provided by the elastomeric cover 225. One skilled in the art understands the requirement for multiple redundancies for critical systems.

In some embodiments, the outer sole plate 218 may be fastened to a surface of a structure to allow a user to attach an inner boot and inner sole plate combination 210/212, and thus a foot or feet, to the outer sole plate 218 by inserting a toe under the toe bar 208 and fastening a catch 226 to a heel-latch mechanism 222. In this manner a user may remain in a substantially fixed position relative to the structure that the outer sole plate 218 is fastened to. This is particularly important when working in an unstable environment such as deep sea, micro gravity or zero gravity environments. In other embodiments, an outer sole plate 218 is part of an outer boot as illustrated in FIG. 8. In some embodiments a toe bar is an adjustable spring that applies an axial force toward the heel mechanism securing the inner sole plate to the outer sole plate under multi-directional movement. One skilled in the art understands that a toe bar 208 may be employed for fastening an inner boot to a binding that is affixed to a structure although other applications may employ a heel mechanism affixed to a structure for engaging the heel of an inner boot without the need to engage a toe under a toe bar.

Figure 12:
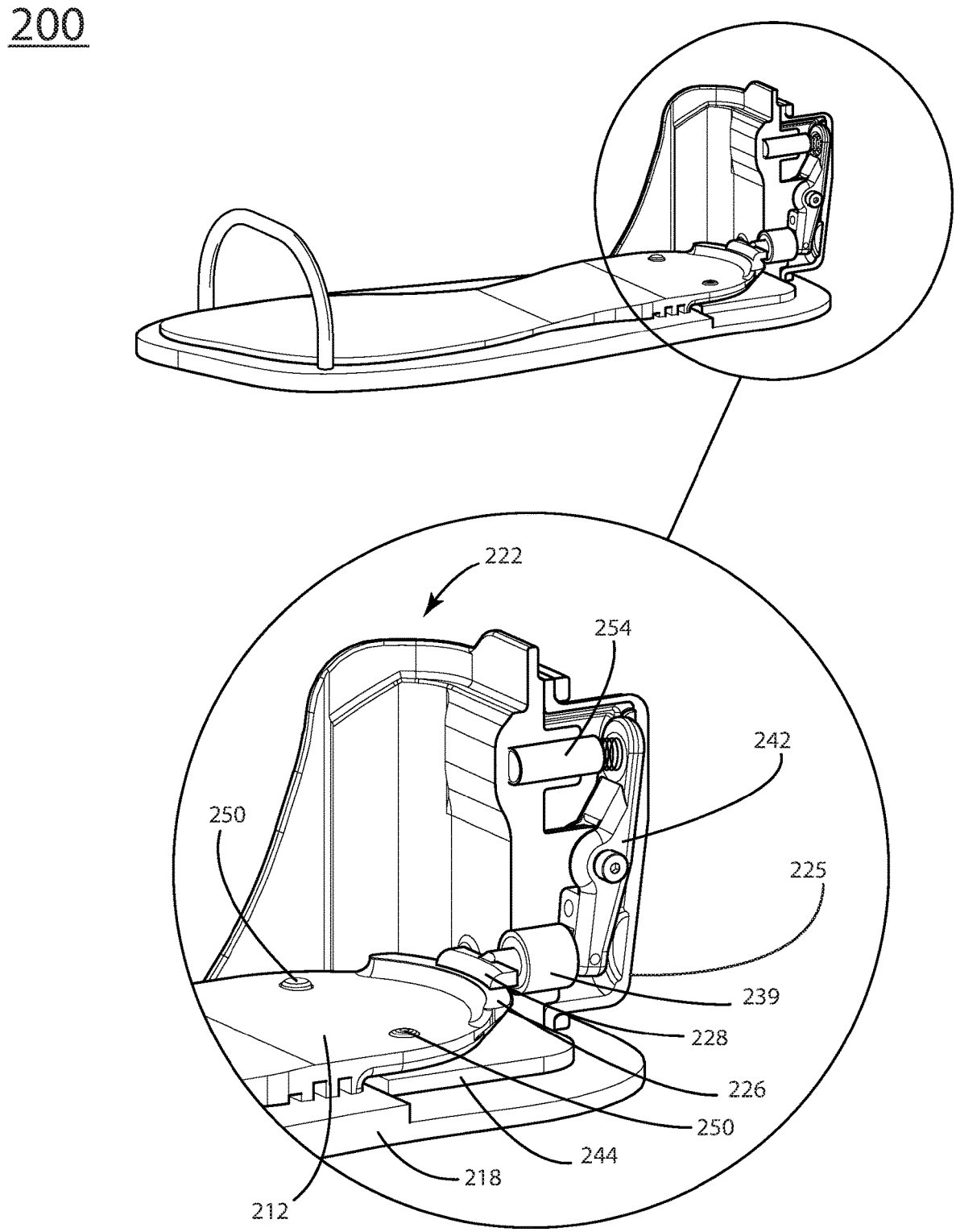
FIG. 12 is a rear perspective view.
Figure 13:
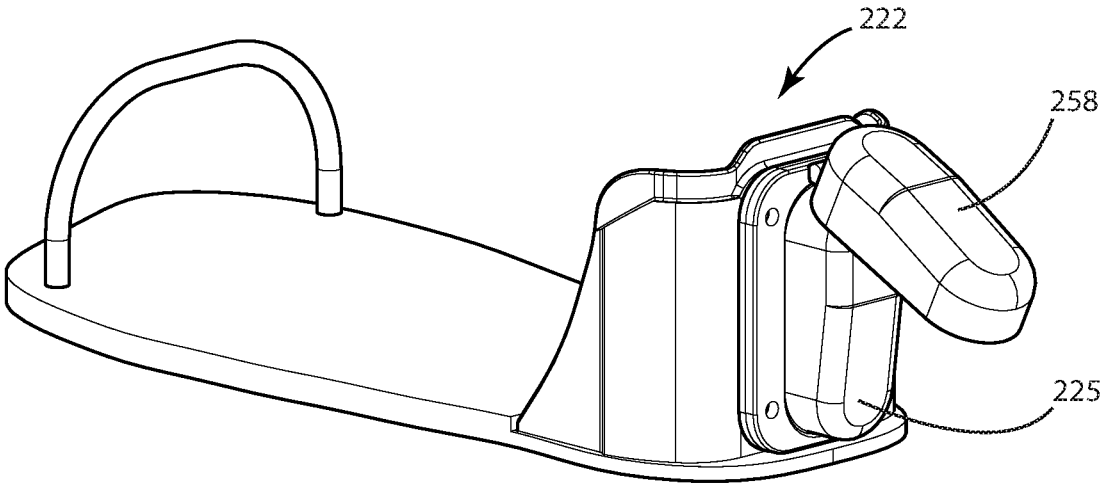
FIG. 13 is a rear perspective view illustrating a secondary cover.

Referring to FIG. 12, the outer boot 216 includes a structural ring 223 for attaching outer boot 216 to the leg of a pressurized suit. Cover 225 also acts as a tertiary seal of the inner space suit pressure barrier, in compliance with NASA requirement for critical seals such as maintaining a space suit's internal environment.

In all embodiments the strength required to compress and release included spring elements are within the strength values outlined in NASA/SP-2010-3407 titled HUMAN INTEGRATION DESIGN HANDBOOK for male and female crew ranging from $5^{th}$ to $95^{th}$ percentile, and may be easily modified if the percentile range increases.

An inner-sole plate 212 is engaged with an inner boot 210 and an outer-sole plate 218. A heel mechanism 222 is connected to an outer-sole plate 218 which is in turn connected to the upper of an outer boot 216 which includes a connection ring 222 which connects the outer boot to the let of a pressurized suit. The inner-sole plate 212 is affixed to an inner boot 210. One skilled in the art understands that an inner-sole plate may be manufactured as part of an inner boot 210 or may be affixed to an existing boot. The inner-sole plate includes a catch 226 for engaging with a latch 228 in the heel mechanism 222. The inner-sole plate further includes at least one alignment hole 252 proximal to the heel of the inner boot 210, for alignment with at least one alignment pin 250 in the outer-sole plate 218. A compressible elastic material 244 surrounds alignment pin(s) 250. Dashed lines 209 depict the alignment between alignment hole(s) 252 and alignment pin(s) 250. One skilled in the art understands that pins may be machined in various shapes including cylindrical, ovate or multi-sided to prevent twisting. In some embodiments a catch 226 is designed with a sufficiently low profile so as to minimize snagging on the interior surfaces of a pressurized suit.

Figure 11:
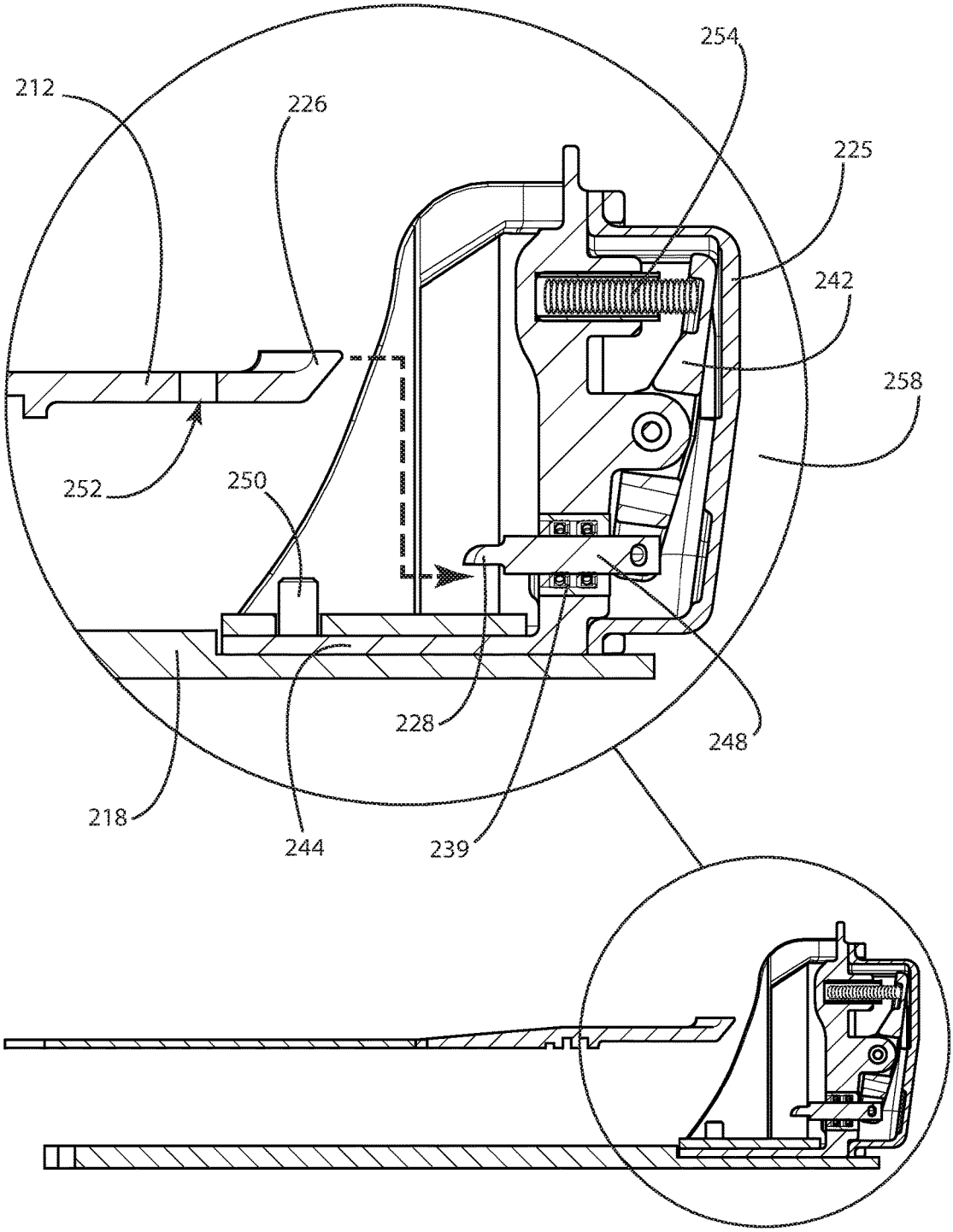
FIG. 11 is partial section, detailed view.

FIGS. 11 and 12 illustrate the heel mechanism 222 of example embodiment 200. An outer-sole plate 218 includes at least one line-up pin 250 that aligns with at least one hole 252 in the inner-sole plate 212. An elastomeric pad 244 provides pressure between the catch 226 and latch 228 when the inner-sole plate 212 and outer-sole plate 218 are connected at the heel mechanism 222. The inner-sole plate 212 includes a catch 226 that mates with a latch 228 in the heel mechanism 222. The latch 228 is connected to a shaft 248 that is coupled by a pivot to a linkage 242. The linkage is connected to a spring 254. One skilled in the art understands that a spring 254 may be a compression spring and may also be a compressible elastomeric material or a gas piston or the like. An outer covering 225 is made up of a flexible material such as a castable elastomer or elastomeric material. The latch 228 is released by moving the linkage 242 against the spring 254 so as to compress the spring, thus pivoting the linkage and moving the shaft 248 away from the catch 226 to release the catch 226 from the latch 228. A secondary cover 258 covers the elastomeric cover 225 to prevent unintended actuation of the linkage. One skilled in the art understands that a secondary action is often required for the release of a mechanism to prevent unintended actuation. In other embodiments where a secondary action is not required the apparatus may function with a single action and without the secondary cover 258. The elastomeric cover 225 provides protection from the mechanism from ambient dust and debris.

The inner sole to outer sole combinations described above are applicable to any number of shoes or boots intended to secure a wearer to a platform or within a surface boot or shoe.

The invention claimed is:

1. An apparatus for fastening a foot to a surface comprising:

a catch fixedly engaged with a sole of a piece of footwear proximal to a heel portion of said sole; and a heel mechanism fixedly engaged with said surface; and
a latch movably engaged with said heel mechanism for removably engaging said catch, and
an elastomeric pad fixedly engaged with said heel mechanism proximal to said catch; and
a linkage movably engaged with said latch, said linkage comprising
a horizontal member having a first end and a second end, the first end fixedly engaged with said latch; and
a vertical member having a top end, a center, and a bottom end; and
said horizontal member second end pivotally engaged with said vertical member bottom end; and
said vertical member center pivotally engaged with a pivot; and
said vertical member top end movably engaged with a spring; wherein the sole of a piece of footwear is pressed against said elastomeric pad and said latch is moved so as to removably engage said catch, said spring maintains the linkage in a normally closed position over said catch; movement of the vertical member against the spring pivots the vertical member and moves said horizontal member horizontally to release said catch, and wherein the elastomeric pad maintains pressure between said catch and latch, and wherein the piece of footwear is removably engaged with said surface.

2. The apparatus of claim 1 further comprising:
a toe bar engaged with said surface; and
said toe bar under adjustable spring tension; wherein
the toe bar provides axial force toward the heel mechanism, and a user may insert at least one toe under said toe bar while engaging said catch to said latch, to removably engage at least one foot to said surface.

3. The apparatus of claim 1 further comprising:
said surface fixedly engaged with a structure; wherein
the user is held fast to the structure while removably engaged with said surface.

4. The apparatus of claim 1 wherein:
said surface is the sole of an outer boot; wherein
said outer boot is further engaged with a pressurized suit.

5. The apparatus of claim 1 further comprising:
a protrusion extending from said surface; and
a receptacle in said sole of a piece of footwear; wherein
said protrusion fits in said receptacle for aligning said sole with said surface.

6. The apparatus of claim 1 further comprising:
an elastomeric cover fitted over said heel mechanism; wherein
said latch is operable through said elastomeric cover by deforming said elastomeric cover while said elastomeric cover prevents snagging of heel mechanism components with inner layers of a provided compression suit.

7. The apparatus of claim 1 further comprising:
an elastomeric cover fitted over said heel mechanism; and
a rigid cover, removably engaged with said elastomeric cover: wherein
said latch is operable through said elastomeric cover and said rigid cover must be removed prior to operating said latch through said elastomeric cover.

8. An apparatus for fastening a foot to a surface comprising:
at least one receptacle fixedly engaged with a sole of a piece of footwear; and
at least one pin for being received by said at least one receptacle; and
said at least one pin fixedly engaged with a surface; and
said at least one receptacle including a spring plate for movably engaging with said at least one pin; and
said spring in combination with said spring plate, exerting pressure on said pin; and
a catch fixedly engaged with said sole of a piece of footwear; and
said catch proximal to a heel portion of said sole; and
a latch movably engaged with a heel mechanism for removably engaging said catch, and
said heel mechanism fixedly engaged with said surface; and
an elastomeric pad fixedly engaged with said heel mechanism proximal to said catch when said catch is removably engaged with said latch; wherein
the sole of a piece of footwear is pressed against said elastomeric pad and said latch is moved so as to removably engage said catch, the elastomeric pad maintains pressure between said catch and latch, and wherein the piece of footwear is removably engaged with said surface.

9. The apparatus of claim 8 wherein:
said receptacle is proximal to the toe of said sole.

10. The apparatus of claim 8 wherein:
said surface fixedly engaged with a structure; wherein
the user is held fast to the structure while removably engaged with said surface.

11. The apparatus of claim 8 wherein:
said surface is the sole of an outer boot; wherein
said outer boot is further engaged with a pressurized suit.

12. The apparatus of claim 8 further comprising:
said spring having a first end and a second end; and
said first end engaged with said spring plate; and
said second end movably engaged with an adjustment screw that is coaxial with said spring; wherein
movement of said adjustment screw changes the compression of said spring increasing pressure on said spring plate when moved in one direction, and
decreasing pressure on said spring plate when moved in an opposite direction.

13. The apparatus of claim 8 further comprising:
a linkage movably engaged with said latch, said linkage comprising:
a horizontal member having a first end and a second end, the first end fixedly engaged with said latch; and
a vertical member having a top end, a center, and a bottom end; and
said horizontal member movably engaged with a spring providing tension on said horizontal member and maintaining it in a normally closed position over said catch; and
said horizontal member second end pivotally engaged with said vertical member bottom end; and
said vertical member center pivotally engaged with a pivot; and
said vertical member top end fixedly engaged with a cord; wherein
said spring maintains the linkage in a normally closed position over said catch;
movement of said cord pivots the vertical member about said center and moves said horizontal member horizontally to release said catch.

14. The apparatus of claim 8 further comprising:
said heel mechanism housed in a form including a beveled portion having a top and a bottom; and
said bottom proximal to said latch; and
said top above said latch; wherein said sole of a piece of footwear and said catch are guided toward said latch by said beveled portion, when a user steps into said heel mechanism.

* * * * *